US012116710B2

(12) United States Patent
Dillon

(10) Patent No.: US 12,116,710 B2
(45) Date of Patent: Oct. 15, 2024

(54) METHOD FOR DETECTING A LOW WATER PRESSURE IN A WASHING MACHINE APPLIANCE

(71) Applicant: Haier US Appliance Solutions, Inc., Wilmington, DE (US)

(72) Inventor: Nicholas Matthew Dillon, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 794 days.

(21) Appl. No.: 17/211,960

(22) Filed: Mar. 25, 2021

(65) Prior Publication Data

US 2022/0307184 A1 Sep. 29, 2022

(51) Int. Cl.

| | |
|---|---|
| ***D06F 33/34*** | (2020.01) |
| ***D06F 33/54*** | (2020.01) |
| ***D06F 34/22*** | (2020.01) |
| ***D06F 39/08*** | (2006.01) |
| ***D06F 103/18*** | (2020.01) |
| ***D06F 103/50*** | (2020.01) |
| ***D06F 105/02*** | (2020.01) |

(52) U.S. Cl.

CPC ..... *D06F 33/34* (2020.02); *D06F 34/22* (2020.02); *D06F 39/087* (2013.01); *D06F 39/088* (2013.01); *D06F 33/54* (2020.02); *D06F 2103/18* (2020.02); *D06F 2103/50* (2020.02); *D06F 2105/02* (2020.02)

(58) Field of Classification Search

CPC ..... D06F 33/34; D06F 33/54; D06F 34/22; D06F 39/087; D06F 39/088; D06F 2103/18; D06F 2105/02

See application file for complete search history.

(56) References Cited

U.S. PATENT DOCUMENTS

2021/0025104 A1* 1/2021 Ha ..... G06N 5/04
2021/0108356 A1* 4/2021 Velasco ..... D06F 34/22

FOREIGN PATENT DOCUMENTS

CN 107904856 B 4/2020
CN 111041781 A 4/2020

* cited by examiner

*Primary Examiner* — Joseph L. Perrin
(74) *Attorney, Agent, or Firm* — Dority & Manning, P.A.

(57) ABSTRACT

Washing machine appliances and methods of operating the same are provided. Such methods may include, and/or appliances may be configured for, receiving a command to commence an operating cycle of the washing machine appliance and filling the wash tub with wash liquid from a fluid circulation system configured for providing fluid to the wash tub via an inlet of the fluid circulation system in response to the command. Methods may further include and/or appliances may be configured for, obtaining one or more images of the inlet of the fluid circulation system during the fill step using a camera mounted within the cabinet. The camera is positioned and oriented with the inlet within a field of vision of the camera. Based on the one or more images, a determination is made whether a water pressure provided to the fluid circulation system is above a predetermined minimum water pressure.

16 Claims, 9 Drawing Sheets

METHOD FOR DETECTING A LOW WATER PRESSURE IN A WASHING MACHINE APPLIANCE

FIELD OF THE INVENTION

The present subject matter relates generally to washing machine appliances, and more particularly to methods for detecting a low water pressure in washing machine appliances.

BACKGROUND OF THE INVENTION

Washing machine appliances generally include a tub for containing wash liquid, e.g., water, detergent, and/or bleach, during operation of such washing machine appliances. A wash basket is rotatably mounted within the wash tub and defines a wash chamber for receipt of articles for washing, and an agitation element is rotatably mounted within the wash basket. Washing machine appliances are typically equipped to operate in one or more modes or cycles, such as wash, rinse, and spin cycles. For example, during a wash or rinse cycle, the wash fluid is directed into the wash tub in order to wash and/or rinse articles within the wash chamber. In addition, the wash basket and/or the agitation element can rotate at various speeds to agitate or impart motion to articles within the wash chamber, to wring wash fluid from articles within the wash chamber, etc.

Conventional washing machine appliances use a water fill algorithm that fills the wash tub by opening a water fill valve for a predetermined amount of time determined as a function of an average flow rate and the desired fill level. For example, if the average flow rate is five gallons per minute and the desired fill level is 15 gallons, the controller would open the water fill valve for three minutes. However, washing machine appliances are frequently installed in locations with a low water pressure, which can result in a lower average flow rate. Conventional fill algorithms do not factor in this reduction in flow rate, so opening the water fill valve for an amount of time calculated assuming the average flow rate will result in less water in the wash tub and decreased wash performance.

Accordingly, a washing machine appliance including features and control algorithms for an improved water fill process would be useful. More specifically, washing machine appliances and methods of operating washing machine appliances that detect when a water pressure level supplied for a fill of the washing machine appliance is low would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a method of operating a washing machine appliance is provided. The washing machine appliance includes a cabinet, a wash tub mounted within the cabinet and configured for containing fluid during operation of the washing machine appliance, and a wash basket rotatably mounted within the wash tub. The wash basket defines a wash chamber configured for receiving laundry articles. The method includes receiving a command to commence an operating cycle of the washing machine appliance. The method further includes filling the wash tub with wash liquid in response to the command. The wash liquid flows from a fluid circulation system configured for providing fluid to the wash tub via an inlet of the fluid circulation system. The method also includes obtaining one or more images of the inlet of the fluid circulation system during the fill step using a camera mounted within the cabinet. The camera is positioned and oriented with the inlet within a field of vision of the camera. Based on the one or more images, the method includes determining whether a water pressure provided to the fluid circulation system is above a predetermined minimum water pressure.

In another exemplary embodiment, a washing machine appliance is provided. The washing machine appliance includes a cabinet, a wash tub mounted within the cabinet and configured for containing fluid during operation of the washing machine appliance, and a wash basket rotatably mounted within the wash tub. The wash basket defines a wash chamber configured for receiving laundry articles. The washing machine appliance also includes a fluid circulation system configured for providing fluid to the wash tub via an inlet of the fluid circulation system. A camera is mounted within the cabinet, and the camera is positioned and oriented with the inlet within a field of vision of the camera. The washing machine appliance further includes a controller. The controller is configured to receive a command to commence an operating cycle of the washing machine appliance and to fill the wash tub with wash liquid from the inlet in response to the command. The controller is further configured to obtain one or more images of the inlet during the fill step using the camera. Based on the one or more images, the controller determines whether a water pressure provided to the fluid circulation system is above a predetermined minimum water pressure.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
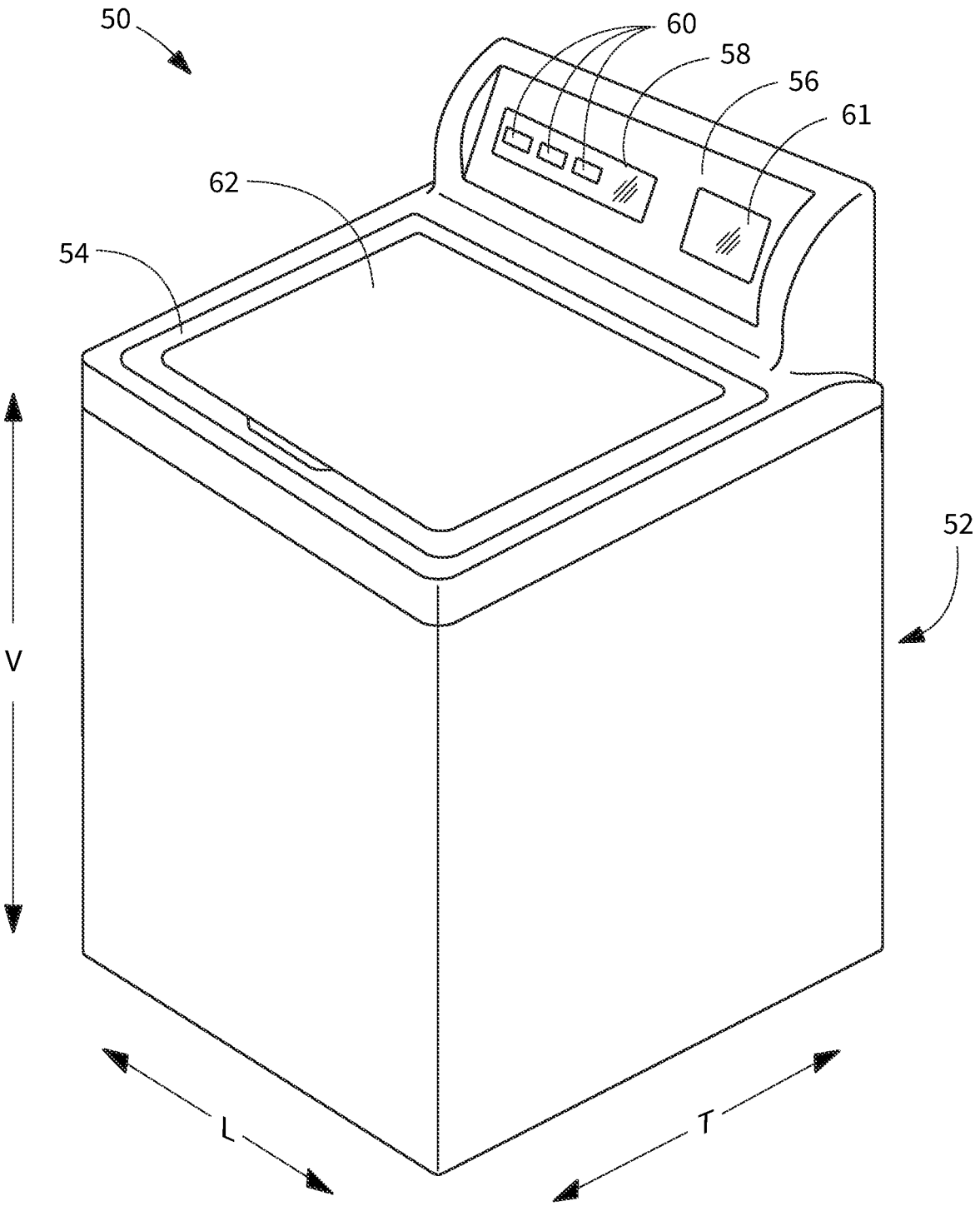
FIG. 1 provides a perspective view of a washing machine appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

FIG. 1 is a perspective view of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and/or other items of interest to machine users. A lid 62 is mounted to cover 54 and is rotatable between an open position (not shown) facilitating access to a wash tub 64 (FIG. 2) located within cabinet 52 and a closed position (shown in FIG. 1) forming an enclosure over wash tub 64.

Figure 2:
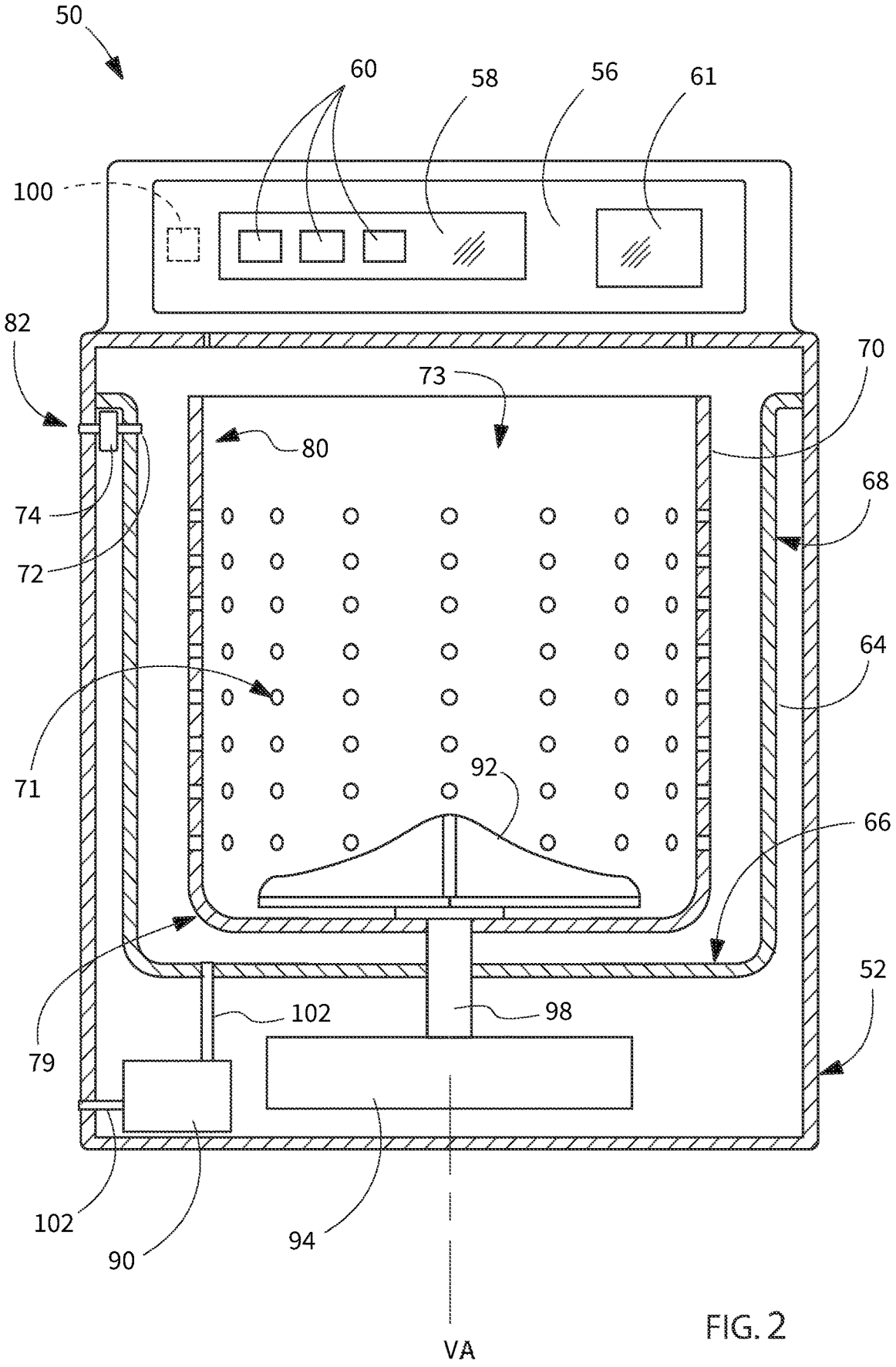
FIG. 2 provides a front, section view of the exemplary washing machine appliance of FIG. 1.

FIG. 2 provides a front, cross-section view of washing machine appliance 50. As may be seen in FIG. 2, wash tub 64 includes a bottom wall 66 and a sidewall 68. A wash basket 70 is rotatably mounted within wash tub 64. In particular, wash basket 70 is rotatable about a vertical axis VA. Thus, washing machine appliance is generally referred to as a vertical axis washing machine appliance. Wash basket 70 defines a wash chamber 73 for receipt of articles for washing and extends, e.g., vertically, between a bottom portion 79 and a top portion 80. Wash basket 70 includes a plurality of perforations 71 therein to facilitate fluid communication between an interior of wash basket 70 and wash tub 64.

An inlet or spout 72 is configured for directing a flow of fluid into wash tub 64. The spout 72 may be a part of a fluid circulation system of the washing machine appliance, such as an inlet of the fluid circulation system. In particular, inlet 72 may be positioned at or adjacent top portion 80 of wash basket 70. Inlet 72 may be in fluid communication with a water supply (not shown) in order to direct fluid (e.g., clean water) into wash tub 64 and/or onto articles within wash chamber 73 of wash basket 70. In some instances, the water supply may provide a low water pressure to the washing machine appliance, and/or a pressure loss may occur within the washing machine appliance. As will be described in more detail below, embodiments of the present disclosure include methods of detecting such low water pressure and washing machine appliances configured to detect such low water pressure. A valve 74 regulates the flow of fluid through inlet 72. For example, valve 74 can selectively adjust to a closed position in order to terminate or obstruct the flow of fluid through inlet 72. In some embodiments, the inlet 72 may be or include a drawer, such as a detergent drawer or additive drawer, through which water flows before flowing into the wash tub 64 and/or wash chamber 73. For example, in embodiments which include the drawer, the water may mix with an additive in the drawer, thereby creating a wash liquid comprising the water and the additive dissolved therein or intermixed therewith, and the wash liquid may then flow into the wash chamber 73 via the inlet 72 (which may be at least partially defined by, e.g., a wall or other portion of the drawer in such embodiments) after a certain liquid volume or level within the drawer has been reached.

A pump assembly 90 (shown schematically in FIG. 2) is located beneath tub 64 and wash basket 70 for gravity assisted flow from wash tub 64. Pump 90 may be positioned along or in operative communication with a drain line 102 which provides fluid communication from the wash chamber 73 of the basket 70 to an external conduit, such as a wastewater line (not shown). In some embodiments, the pump 90 may also or instead be positioned along or in operative communication with a recirculation line (not shown) which extends back to the tub 64, e.g., in addition to the drain line 102.

An agitation element 92, shown as an impeller in FIG. 2, is disposed in wash basket 70 to impart an oscillatory motion to articles and liquid in wash chamber 73 of wash basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, single direction rotation at the other end). As illustrated in FIG. 2, agitation element 92 is oriented to rotate about vertical axis VA. Wash basket 70 and agitation element 92 are driven by a pancake motor 94. As motor output shaft 98 is rotated, wash basket 70 and agitation element 92 are operated for rotatable movement within wash tub 64, e.g., about vertical axis VA. Washing machine appliance 50 may also include a brake assembly (not shown) selectively applied or released for respectively maintaining wash basket 70 in a stationary position within wash tub 64 or for allowing wash basket 70 to spin within wash tub 64.

Operation of washing machine appliance 50 is controlled by a processing device or controller 100, that is operatively coupled to the user interface input located on washing machine backsplash 56 for user manipulation to select washing machine cycles and features. In response to user manipulation of the user interface input, controller 100 operates the various components of washing machine appliance 50 to execute selected machine cycles and features.

Controller 100 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 100 via one or more signal lines or shared communication busses. It should be noted that controllers 100 as disclosed herein are capable of and may be operable to perform any methods and associated method steps as disclosed herein.

In an illustrative embodiment, laundry items are loaded into wash chamber 73 of wash basket 70, and washing operation is initiated through operator manipulation of control input selectors 60. Wash tub 64 is filled with water and mixed with detergent to form a wash liquid. Valve 74 can be opened to initiate a flow of water into wash tub 64 via inlet 72, and wash tub 64 can be filled to the appropriate level for the amount of articles being washed. Once wash tub 64 is properly filled with wash fluid, the contents of the wash basket 70 are agitated with agitation element 92 for cleaning of laundry items in wash basket 70. More specifically, agitation element 92 may be moved back and forth in an oscillatory motion. The wash fluid may be recirculated through the washing machine appliance 50 at various points in the wash cycle, such as before or during the agitation phase (as well as one or more other portions of the wash cycle, separately or in addition to before and/or during the agitation phase).

After the agitation phase of the wash cycle is completed, wash tub 64 is drained. Laundry articles can then be rinsed by again adding fluid to wash tub 64, depending on the particulars of the cleaning cycle selected by a user, agitation element 92 may again provide agitation within wash basket 70. One or more spin cycles may also be used. In particular, a spin cycle may be applied after the wash cycle and/or after the rinse cycle in order to wring wash fluid from the articles being washed. During a spin cycle, wash basket 70 is rotated at relatively high speeds. In various embodiments, the pump 90 may be activated to drain liquid from the washing machine appliance 50 during the entire drain phase (or the entirety of each drain phase, e.g., between the wash and rinse and/or between the rinse and the spin) and may be activated during one or more portions of the spin cycle.

While described in the context of a specific embodiment of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well.

Figure 3:
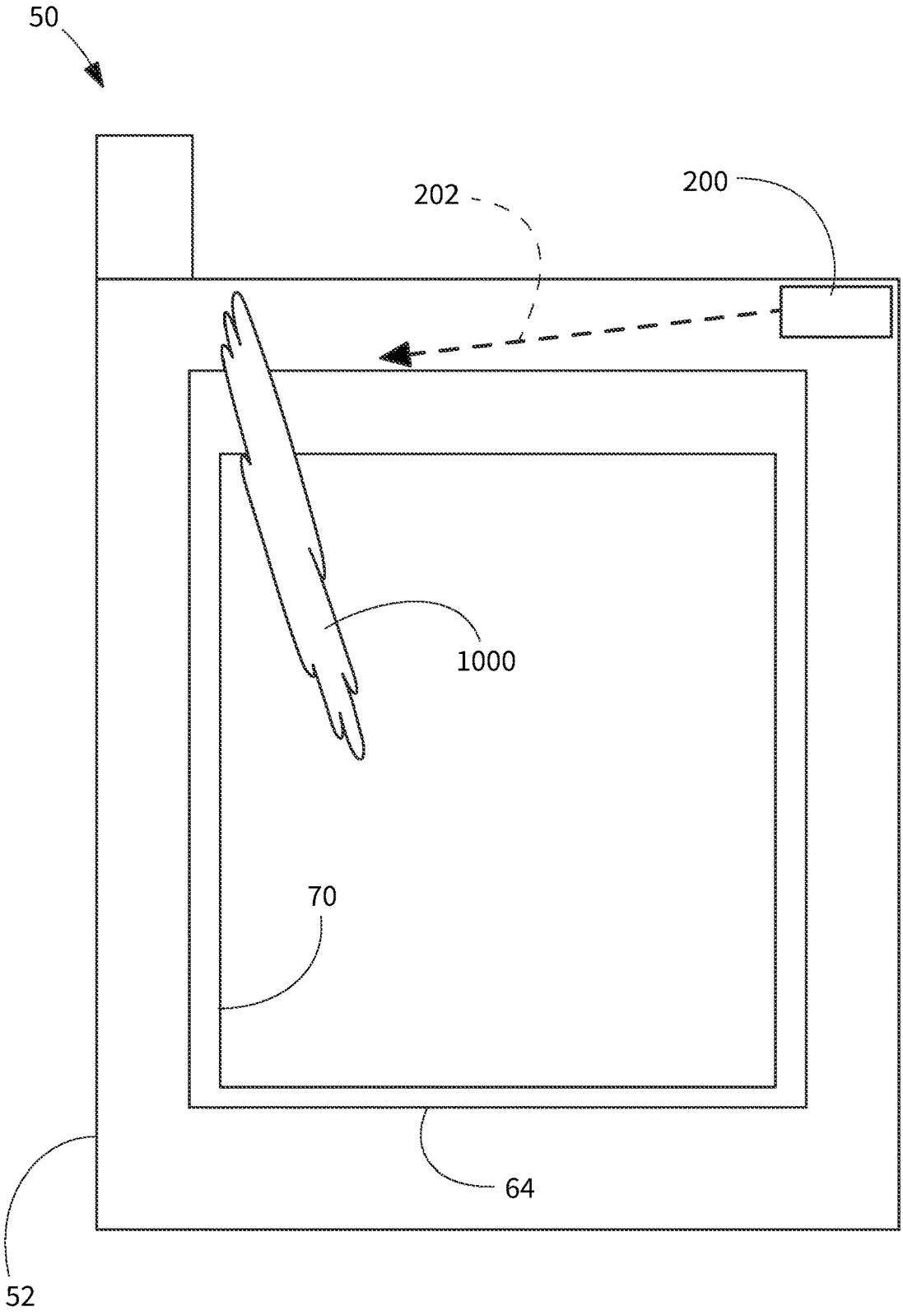
FIG. 3 illustrates a schematic side view of the exemplary washing machine appliance of FIG. 1 according to an exemplary embodiment of the present subject matter.
Figure 4:
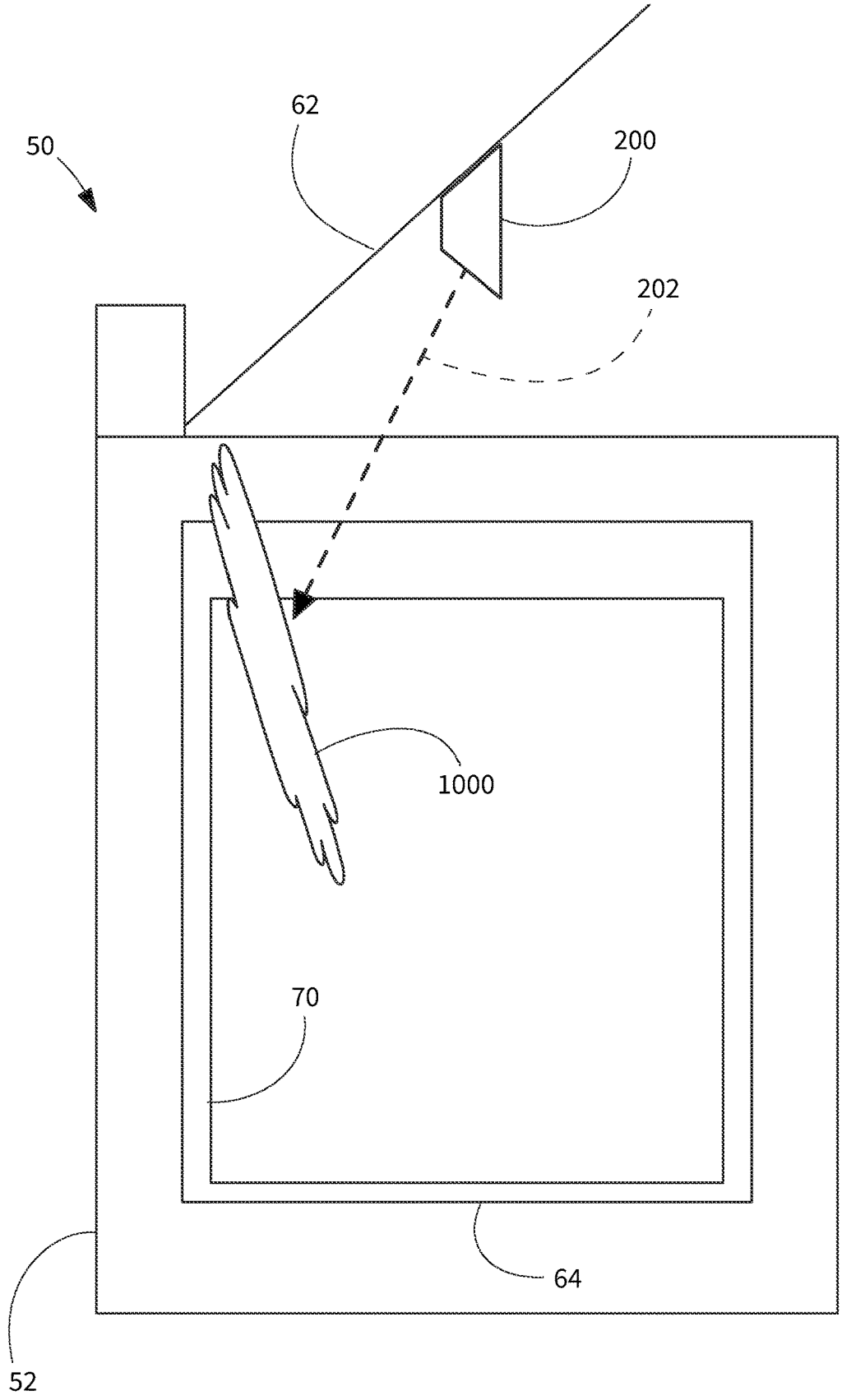
FIG. 4 illustrates a schematic side view of the exemplary washing machine appliance of FIG. 1 according to an additional exemplary embodiment of the present subject matter.

Referring now to FIGS. 3 and 4, washing machine appliance 50 may further include a camera 200 that is generally positioned and configured for obtaining images of wash chamber 73 and/or a stream of fluid, e.g., wash liquid, 1000 flowing into wash chamber 73 of washing machine appliance 50. The camera 200 may be mounted within the cabinet 52, such as to the cabinet 52 itself, e.g., as illustrated in FIG. 3, or to the lid 62, e.g., as illustrated in FIG. 4. Specifically, camera 200 is mounted such that is faces toward the inlet 72 and the inlet 72 is within a field of vision, schematically represented by arrow 202 in FIGS. 3 and 4, of the camera 200. In this manner, camera 200 can take images or video of an inside of wash chamber 73 and remains unobstructed by windows that may obscure or distort such images.

It should be appreciated that camera 200 may include any suitable number, type, size, and configuration of camera(s) 200 for obtaining images of wash chamber 73. In general, camera 200 may include a lens that is constructed from a clear hydrophobic material or which may otherwise be positioned behind a hydrophobic clear lens. So positioned, camera 200 may obtain one or more images or videos of wash chamber 73 and fluid stream 1000, as described in more detail below. In some embodiments, washing machine appliance 50 may further include a tub light (not shown) that is positioned within cabinet 52 or wash chamber 73 for selectively illuminating wash chamber 73 and/or contents therein, such as the fluid stream 1000 flowing into the wash chamber 73.

Notably, controller 100 of washing machine appliance 50 (or any other suitable dedicated controller) may be communicatively coupled to camera 200 and other components of washing machine appliance 50. As explained in more detail below, controller 100 may be programmed or configured for obtaining images using camera 200, e.g., in order to detect certain operating conditions and improve the performance of washing machine appliance 50. In addition, controller 100 may be programmed or configured to perform methods to identify the fluid stream 1000 and to analyze the shape or other geometric properties of the fluid stream within wash chamber 73. Such analysis may be, for example, pixel-based, such as determining one or more dimensions of the fluid stream 1000 based on a number of pixels along one or more lines across or through the fluid stream 1000, and examples of such dimensions will be described in more detail below with reference to various example embodiments.

Various examples of images which may be captured or obtained by the camera 200 are illustrated in FIGS. 5 through 12. As is generally seen throughout FIGS. 5 through 12, the images obtained by the camera 200 generally include at least a portion of the inlet 72 and the wash chamber 73 within the frame of the image. Further, the fluid stream 1000 flowing from the inlet 72 is generally centered within the frame of the image and flows across the image along the vertical direction V, e.g., downward along the vertical direction V, such as at least in part under the influence of gravity. In the exemplary image embodiments illustrated in FIGS. 5 through 12, the Y dimensions are oriented generally along the vertical direction V and the X dimensions, or widths of the fluid stream 1000, are oriented generally perpendicular to the vertical direction V.

The image or images obtained by or with the camera 200, e.g., such as the example images illustrated in FIGS. 5 through 12, may be analyzed to determine that there is low water pressure, e.g., provided to the washing machine appliance 50 and/or a fluid circulation system thereof, based at least in part on the one or more images, e.g., based on an image processing algorithm and a machine learning image recognition process. Each of these image evaluation processes will be described below according to exemplary embodiments of the present subject matter. It should be appreciated that image processing and machine learning image recognition processes may be used together to provide an extra safety factor and redundant detection methods to improve the likelihood of detecting low water pressure. In some exemplary embodiments, such redundant or duplicative detection methods may be desirable to improve the likelihood of accurate detection and eliminate false negatives.

As used herein, the term "image processing algorithm" and the like is generally intended to refer to any suitable methods or algorithms for analyzing images of wash chamber 73 that do not rely on artificial intelligence or machine learning techniques (e.g., in contrast to the machine learning image recognition process as described below). For example, the image processing algorithm may rely on image differentiation, e.g., such as a pixel-by-pixel comparison of two sequential images. Image differentiation may be used to, for example, determine if a geometric property, e.g., shape, area, or dimension, etc., of the fluid stream 1000 changes, such as crosses a threshold, e.g., a minimum or maximum. If there are substantial differences between the sequentially obtained images, this may indicate a change in water pressure provided to the washing machine appliance.

Additional embodiments may also include using a machine learning image recognition process instead of or in addition to an image processing algorithm. In this regard, the images obtained by camera 200 may be used by controller 100 for detecting low water pressure. In addition, it should be appreciated that this image analysis or processing may be performed locally (e.g., by controller 100) or remotely, such as by using distributed computing, a digital cloud, or a remote server. According to exemplary embodiments of the present subject matter, the images obtained with the camera 200 may be analyzed using a neural network classification module and/or a machine learning image recognition process. In this regard, for example, controller 100 may be programmed to implement the machine learning image recognition process that includes a neural network trained with a plurality of images of the fluid stream 1000. By analyzing the images obtained by the camera 200 using this machine learning image recognition process, controller 100 may determine whether there is low water pressure provided to the washing machine appliance 50. According to exemplary embodiments, if low water pressure is detected using either the image processing algorithm or the machine learning image recognition process (or both), responsive action may be implemented.

As used herein, the terms image recognition process and similar terms may be used generally to refer to any suitable method of observation, analysis, image decomposition, feature extraction, image classification, etc. of one or more images or videos taken within a wash chamber of a washing machine appliance. In this regard, the image recognition process may use any suitable artificial intelligence (AI) technique, for example, any suitable machine learning technique, or for example, any suitable deep learning technique. It should be appreciated that any suitable image recognition software or process may be used to analyze images taken by camera 200, and that controller 100 may be programmed to perform such processes and take corrective action.

According to an exemplary embodiment, controller may implement a form of image recognition called region-based convolutional neural network ("R-CNN") image recognition. Generally speaking, R-CNN may include taking an input image and extracting region proposals that include a potential object, such as a particular garment, region of a load of clothes, or the fluid stream. In this regard, a "region proposal" may be regions in an image that could belong to a particular object, such as a fluid stream flowing into the wash basket. A convolutional neural network is then used to compute features from the regions proposals and the extracted features will then be used to determine a classification for each particular region.

According to still other embodiments, an image segmentation process may be used along with the R-CNN image recognition. In general, image segmentation creates a pixel-based mask for each object in an image and provides a more detailed or granular understanding of the various objects within a given image. In this regard, instead of processing an entire image—i.e., a large collection of pixels, many of which might not contain useful information—image segmentation may involve dividing an image into segments (e.g., into groups of pixels containing similar attributes) that may be analyzed independently or in parallel to obtain a more detailed representation of the object or objects in an image. This may be referred to herein as "mask R-CNN" and the like.

According to still other embodiments, the image recognition process may use any other suitable neural network process. For example, the image recognition process may include using Mask R-CNN instead of a regular R-CNN architecture. In this regard, Mask R-CNN is based on Fast R-CNN which is slightly different than R-CNN. In addition, a K-means algorithm may be used. Other image recognition processes are possible and within the scope of the present subject matter.

It should be appreciated that any other suitable image recognition process may be used while remaining within the scope of the present subject matter. For example, the image or images from the camera 200 may be analyzed using a deep belief network ("DBN") image recognition process. A DBN image recognition process may generally include stacking many individual unsupervised networks that use each network's hidden layer as the input for the next layer. According to still other embodiments, the image or images from the camera 200 may be analyzed by the implementation of a deep neural network ("DNN") image recognition process, which generally includes the use of a neural network (computing systems inspired by biological neural networks) with multiple layers between input and output. Other suitable image recognition processes, neural network processes, artificial intelligence ("AI") analysis techniques, and combinations of the above described or other known methods may be used while remaining within the scope of the present subject matter.

Figure 6:
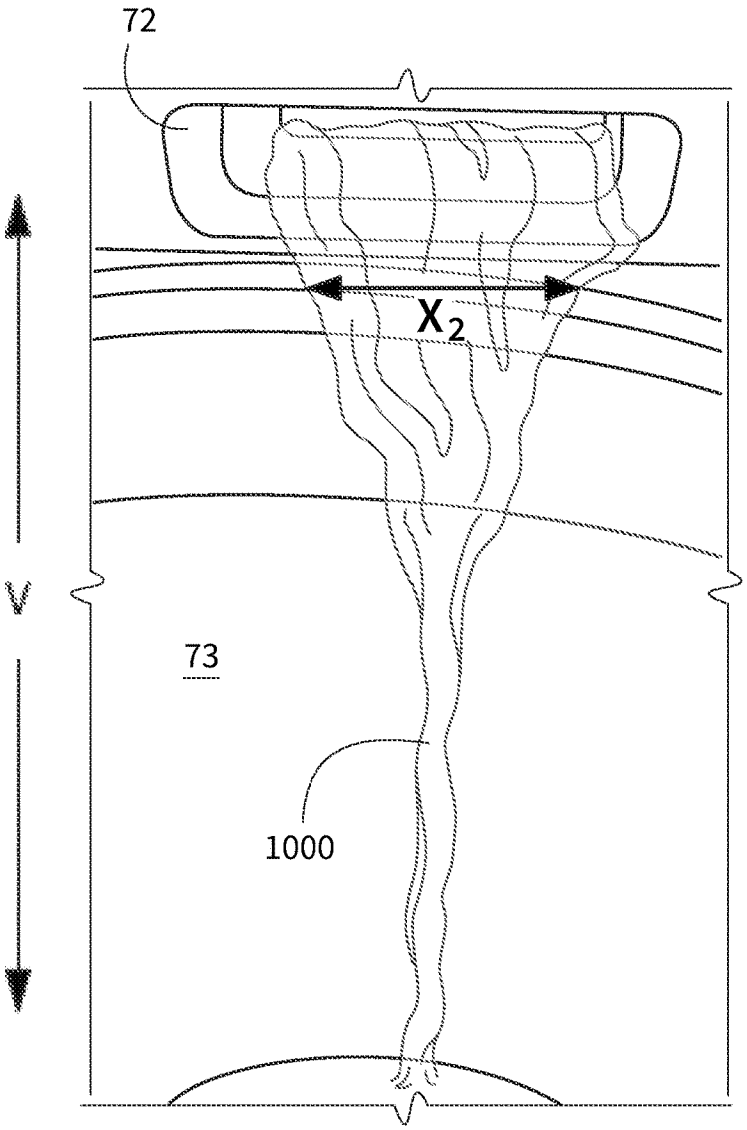
FIG. 6 illustrates an image of a washing machine appliance according to an exemplary embodiment of the present subject matter.
Figure 5:
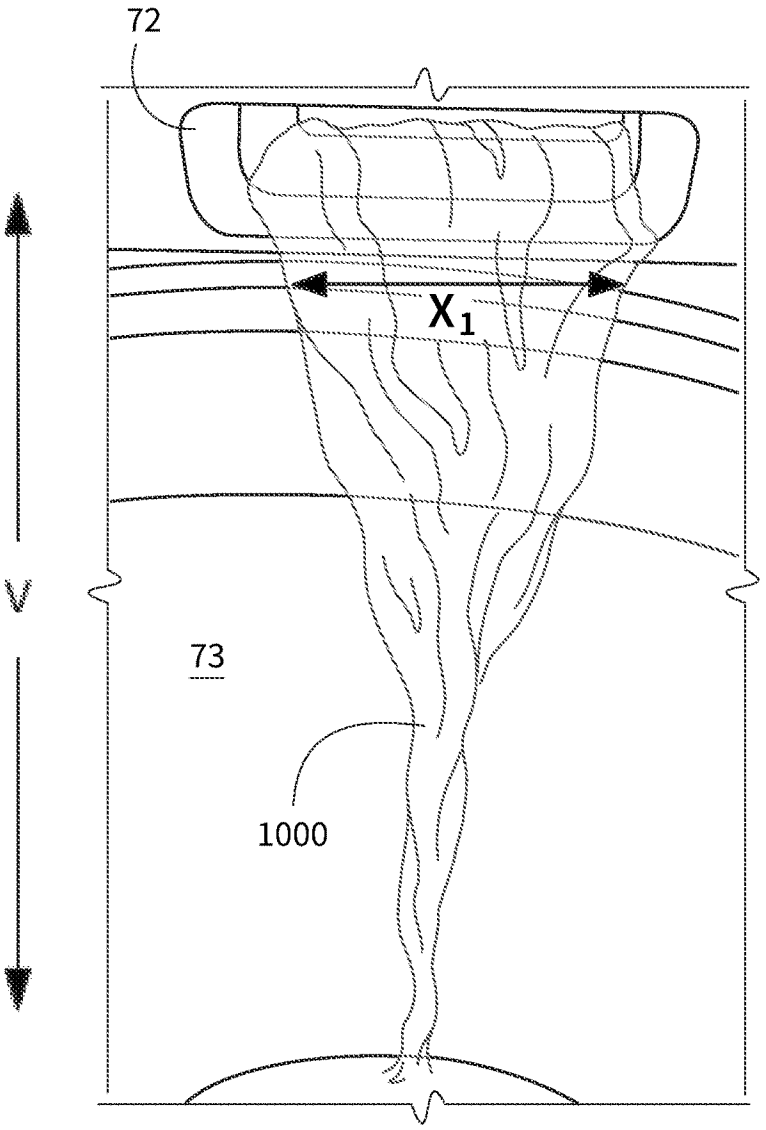
FIG. 5 illustrates an image of a washing machine appliance according to an exemplary embodiment of the present subject matter.

Turning now to specifically FIGS. 5 and 6, FIG. 5 illustrates an image of a fluid stream 1000 that is flowing at a normal rate, e.g., the expected or assumed rate on which the flow time (valve open time) is based, or within an acceptable tolerance range of the normal rate, whereby the amount, e.g., volume, of wash liquid provided to the wash chamber 73 will be within a target fill range for a given load of articles. Those of ordinary skill in the art will recognize that the target fill range may correspond to a load size and/or load type of each load of articles. By contrast, FIG. 6 illustrates a fluid stream 1000 which is indicative of low water pressure, which may be differentiated or identified based on a geometric property of the fluid stream. For example, applying one or more of the exemplary image recognition and analysis operations described above, exemplary embodiments of the present disclosure determine whether a water pressure provided to the fluid circulation system is above a predetermined minimum water pressure based on the one or more images obtained using the camera 200. Thus, the pertinent geometric property of the fluid stream may be ascertained, e.g., extracted or otherwise determined, from the one or more images obtained by the camera 200. In the exemplary embodiments of FIGS. 5 and 6, the geometric property of interest is a dimension identified as $X_1$ in the example of FIGS. 5 and $X_2$ in the example of FIG. 6. The dimensions $X_1$ and $X_2$ each represents the width of the stream 1000 at the widest point thereof, e.g., the largest width of the stream 1000, which may be based on a single point in time, e.g., a single image capture, or may be a largest width of the stream 1000 over a predetermined period of time, e.g., based on a video or a series of images captured over the predetermined period of time. As mentioned above, the dimensions described herein, e.g., the widths $X_1$ and $X_2$, may be determined based on one or more images by recognizing the fluid stream 1000, such as from a region of the image or images, and determining, e.g., counting, a number of pixels lying on the illustrated dimension lines, e.g., widths $X_1$ and $X_2$ in FIGS. 5 and 6. The largest width of the fluid stream 1000, e.g., $X_1$ or $X_2$, may be compared to a predetermined minimum value, e.g., an $X_{min}$ value, which may be, for example, set in software and/or stored in a memory of the controller 100. The value of the largest width, e.g., $X_1$ or $X_2$, may be a number of pixels and the predetermined minimum value may also be a number of pixels. When the largest width of the fluid stream 1000 is greater than or equal to $X_{min}$, for example $X_1$ in the FIG. 5, it may be determined that the water pressure provided to the fluid circulation system is above a predetermined minimum water pressure, and, when the largest width of the fluid stream 1000 is less than $X_{min}$, for example $X_2$ in the example of FIG. 6, it may be determined that the water pressure provided to the fluid circulation system is below the predetermined minimum water pressure.

In response to a determination that the water pressure provided to the fluid circulation system is below the predetermined minimum water pressure, one or more abatement steps may be taken, such as increasing a valve open time, e.g., an open time of valve 74 (FIG. 2) and/or providing a user notification, such as on the display 61 of the washing machine appliance 50 and/or via a remote device such as a smartphone, tablet, etc.

Figure 8:
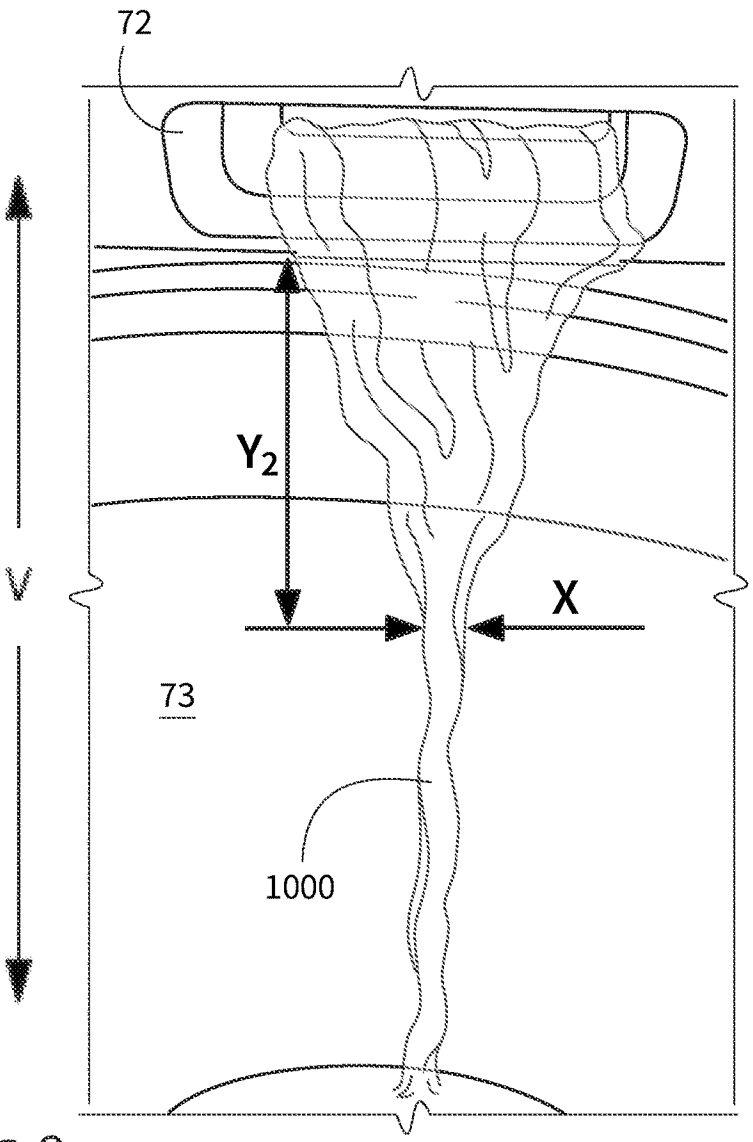
FIG. 8 illustrates an image of a washing machine appliance according to an exemplary embodiment of the present subject matter.
Figure 7:
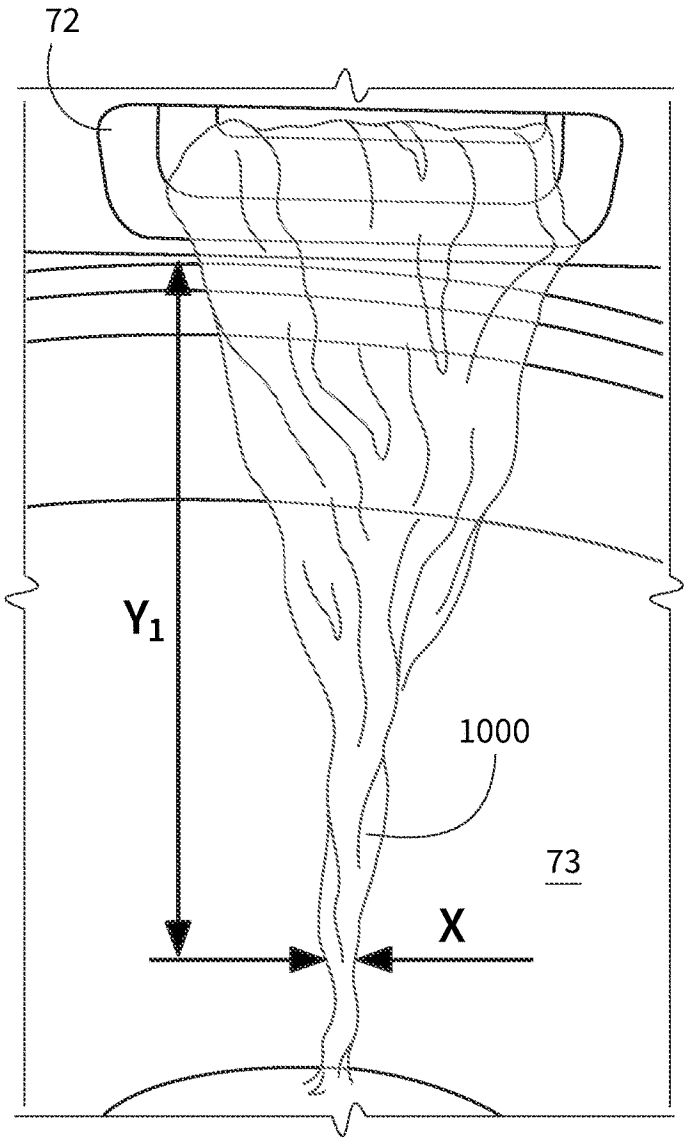
FIG. 7 illustrates an image of a washing machine appliance according to an exemplary embodiment of the present subject matter.

Turning now to FIGS. 7 and 8, in some embodiments, the geometric property may be a distance Y from the inlet 72 at which the fluid stream 1000 reaches a predetermined width X. In particular, FIG. 7 illustrates an image of a fluid stream 1000 that is flowing at a normal rate or within an acceptable tolerance range of the normal rate, similar to FIG. 5 as described above, whereas FIG. 8 illustrates a fluid stream 1000 which is indicative of low water pressure, similar to FIG. 6 as described above. Images such as the example images depicted in FIGS. 7 and 8 may be analyzed, e.g., as described above, to determine whether a water pressure provided to the fluid circulation system is above a predetermined minimum water pressure based on the one or more images obtained using the camera 200. As mentioned, the geometric property of interest in the exemplary embodiments of FIGS. 7 and 8 is a dimension identified as $Y_1$ in FIGS. 7 and $Y_2$ in FIG. 8, each of which represents the distance from the inlet 72 at which the fluid stream 1000 reaches the predetermined width X. The distance, e.g., $Y_1$ or $Y_2$, may be compared to a predetermined minimum value, e.g., a $Y_{min}$ value, which may be, for example, set in software and/or stored in a memory of the controller 100. As mentioned above, the dimension values, e.g., X, $Y_1$, $Y_2$ and $Y_{min}$, may each be a number of pixels, such as a number of pixels within or along a defined line in a region of the image which is recognized as containing, corresponding to, or including the fluid stream 1000. When the vertical distance from the inlet 72 at which the fluid stream 1000 reaches the predetermined width X falls below $Y_{min}$, e.g., instantaneously (such as based on a single image) or for a predetermined period of time, e.g., based on a video or a series of images captured over the predetermined period of time, it may be determined that the water pressure provided to the fluid circulation system is below the predetermined minimum water pressure.

Figure 10:
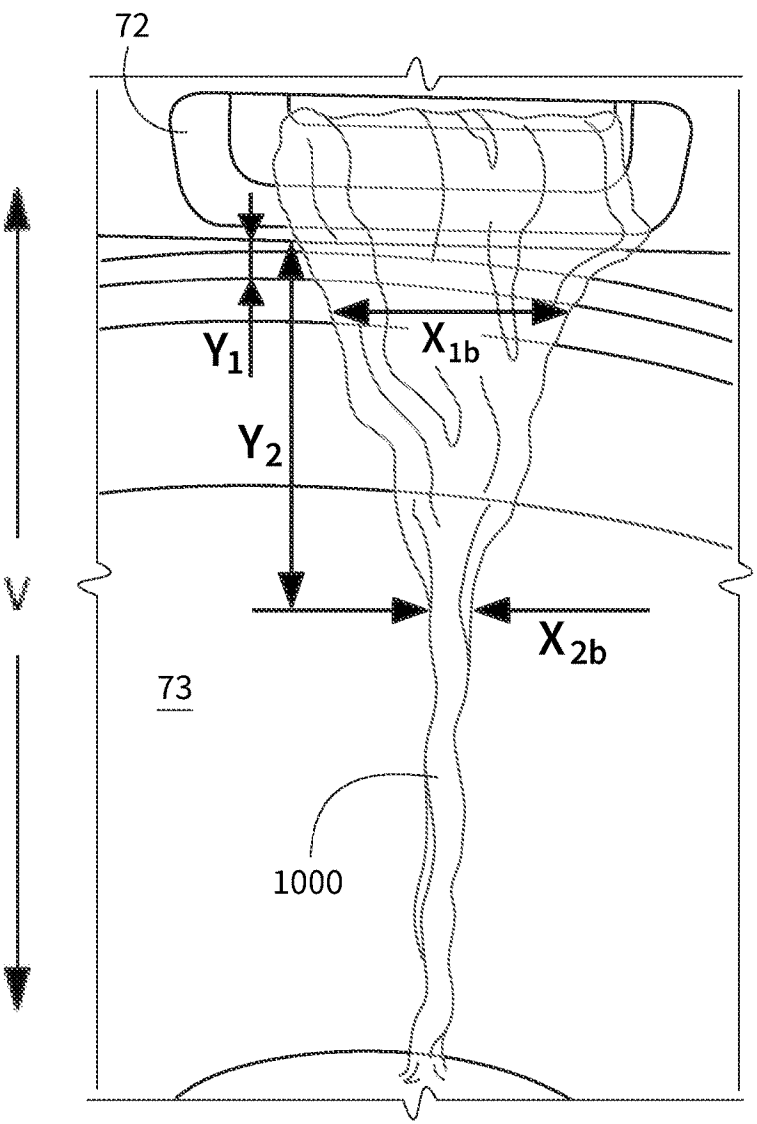
FIG. 10 illustrates an image of a washing machine appliance according to an exemplary embodiment of the present subject matter.
Figure 9:
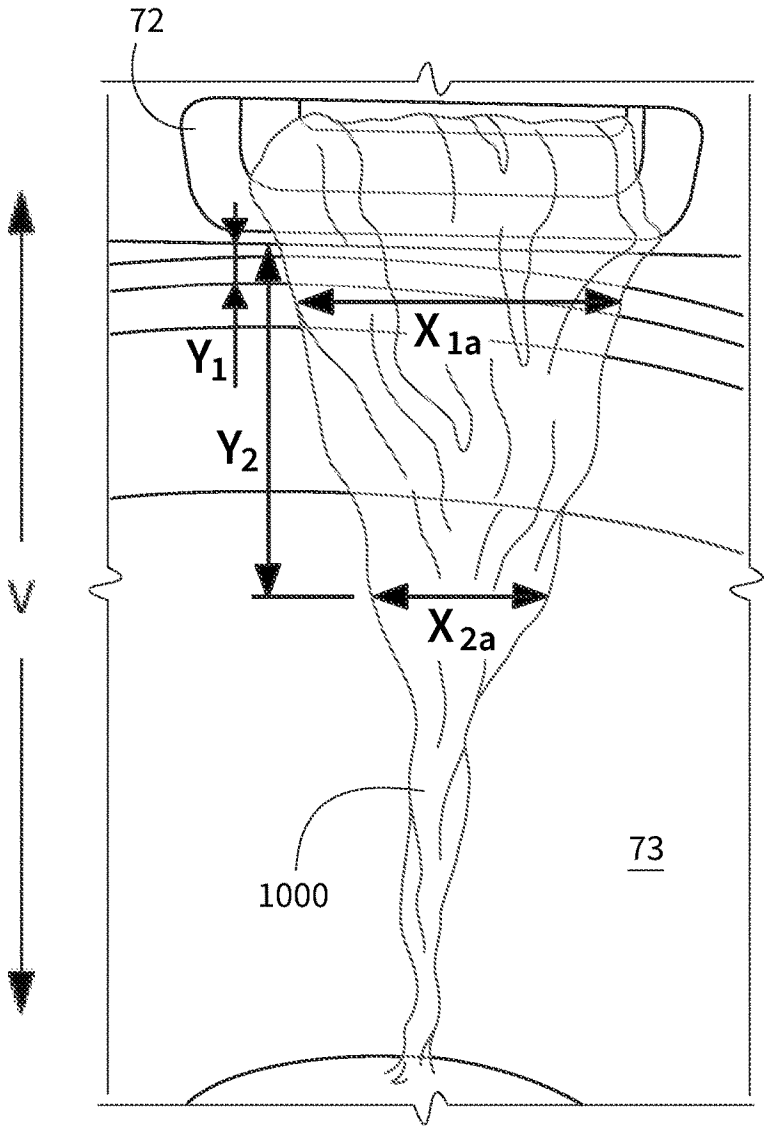
FIG. 9 illustrates an image of a washing machine appliance according to an exemplary embodiment of the present subject matter.

Turning now to FIGS. 9 and 10, in some embodiments, the geometric property may be based on a first width (e.g., $X_{1a}$ or $X_{1b}$) of the fluid stream 1000 at a first distance $Y_1$ from the inlet 72 and a second width (e.g., $X_{2a}$ or $X_{2b}$) of the fluid stream 1000 at a second distance $Y_2$ from the inlet 72. In particular, FIG. 9 illustrates an image of a fluid stream 1000 that is flowing at a normal rate or within an acceptable tolerance range of the normal rate, similar to FIG. 5 as described above, whereas FIG. 10 illustrates a fluid stream 1000 which is indicative of low water pressure, similar to FIG. 6 as described above. Images such as the example images depicted in FIGS. 9 and 10 may be analyzed, e.g., as described above, to determine whether a water pressure provided to the fluid circulation system is above a predetermined minimum water pressure based on the one or more images obtained using the camera 200. In particular embodiments, e.g., as illustrated in FIG. 9 and/or 10, the geometric property may be a ratio of the first width and the second width, wherein a higher ratio indicates that the stream 1000 is tapering down (getting thinner) at a higher rate. The more quickly the width of the fluid stream 1000 attenuates, e.g., the greater the ratio of the first width and the second width, the lower the water pressure. Thus, in some embodiments, the geometric property, e.g., the ratio of the first width and the second width, may be compared to a predetermined maximum value, e.g., an $X_{max}$ value, which may be, for example, set in software and/or stored in a memory of the controller 100. When the ratio of the first width and the second width exceeds $X_{max}$, e.g., instantaneously (such as based on a single image) or for a predetermined period of time, e.g., based on a series of images captured over the predetermined period of time, it may be determined that the water pressure provided to the fluid circulation system is below the predetermined minimum water pressure. In embodiments where the geometric property is the ratio of widths as described, the width values may be, e.g., pixel counts as described, whereas the ratio values may be unitless.

Figure 12:
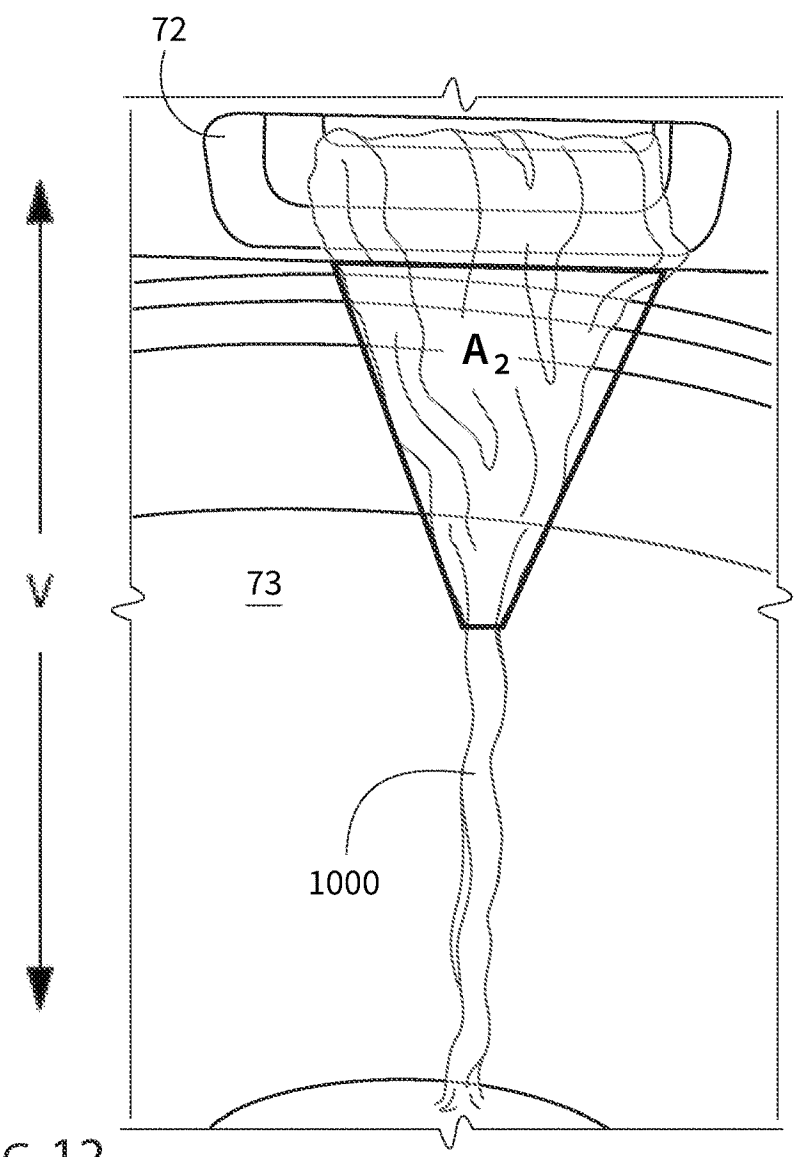
FIG. 12 illustrates an image of a washing machine appliance according to an exemplary embodiment of the present subject matter.
Figure 11:
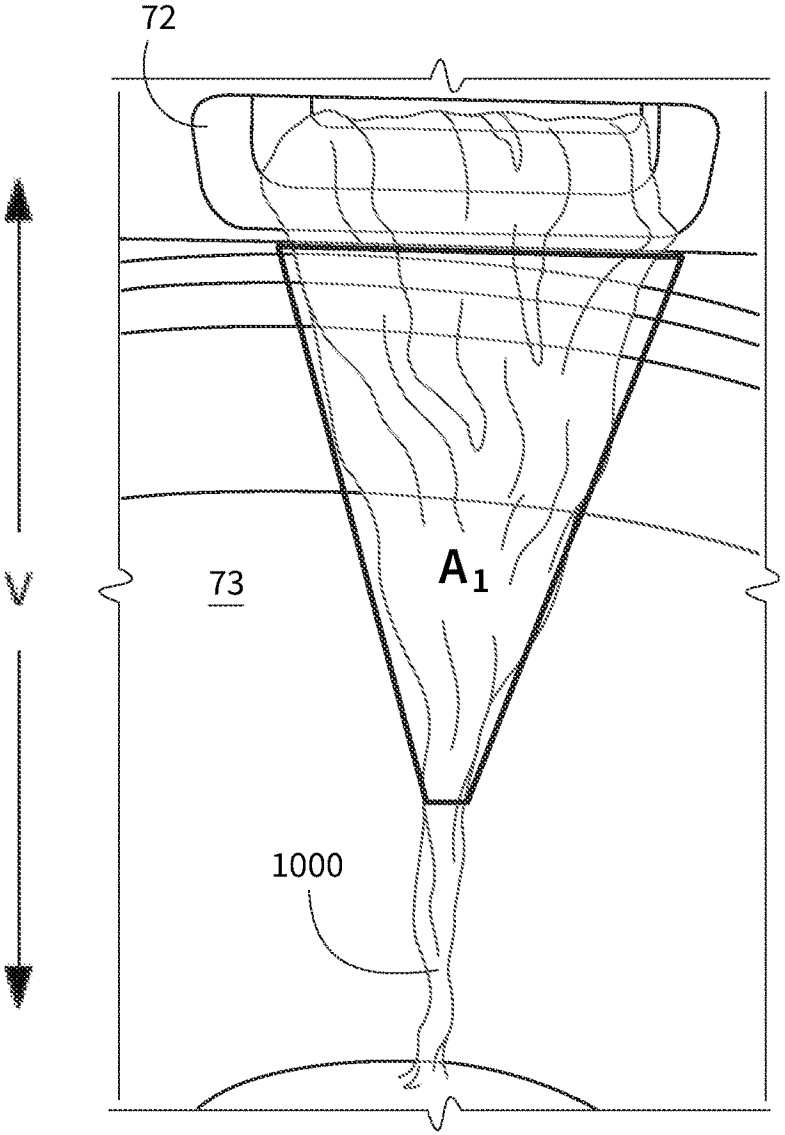
FIG. 11 illustrates an image of a washing machine appliance according to an exemplary embodiment of the present subject matter.

Turning now to FIGS. 11 and 12, in some embodiments, the geometric property may be an area A of the fluid stream 1000. In particular, FIG. 11 illustrates an image of a fluid stream 1000 that is flowing at a normal rate or within an acceptable tolerance range of the normal, expected, rate, similar to FIG. 5 as described above, whereas FIG. 12 illustrates a fluid stream 1000 which is indicative of low water pressure, similar to FIG. 6 as described above. Images such as the example images depicted in FIGS. 11 and 12 may be analyzed, e.g., as described above, to determine whether a water pressure provided to the fluid circulation system is above a predetermined minimum water pressure based on the one or more images obtained using the camera 200. As mentioned, the geometric property of interest in the exemplary embodiments of FIGS. 11 and 12 is an area A (identified as $A_1$ in FIGS. 11 and $A_2$ in FIG. 12). The area may be based on a region of the fluid stream 1000 meeting predetermined criteria. For example, in the embodiments of FIGS. 11 and 12, the area A is defined by a trapezoidal region of the fluid stream 1000 which has predetermined base dimensions, e.g., a predetermined long base dimension and a predetermined short base dimension, whereby the height of the trapezoidal region and the length of the non-parallel sides of the trapezoid may vary with the water pressure. For example, as may be seen by comparing FIGS. 11 and 12, when the water pressure is within a normal or target range, the height will be relatively larger and the non-parallel sides will be relatively longer, resulting in a greater area of the trapezoidal region, e.g., as in FIG. 11, whereas water pressure below the predetermined minimum water pressure will result in and be indicated by a smaller height of the trapezoidal region and correspondingly reduced area A of the fluid stream 1000. In additional embodiments, the area A of the fluid stream 1000 may be calculated based on a triangular region. For example, the triangular region may be interpolated from two or more predetermined points, such as a pair of points (or multiple pairs of points) on opposing outer edges of the fluid stream along a line generally perpendicular to the vertical direction V and spaced apart from the inlet 72 by a predetermined vertical distance (or multiple pairs with each pair at a predetermined vertical distance from the inlet 72), where the apex of the triangle may be defined at the intersection of the interpolated lines. The area, e.g., $A_1$ or $A_2$, may be compared to a predetermined minimum value, e.g., an $A_{min}$ value, which may be, for example, set in software and/or stored in a memory of the controller 100. When the area falls below $A_{min}$, e.g., instantaneously (such as based on a single image) or for a predetermined period of time, e.g., based on a video or a series of images captured over the predetermined period of time, it may be determined that the water pressure provided to the fluid circulation system is below the predetermined minimum water pressure.

Figure 13:
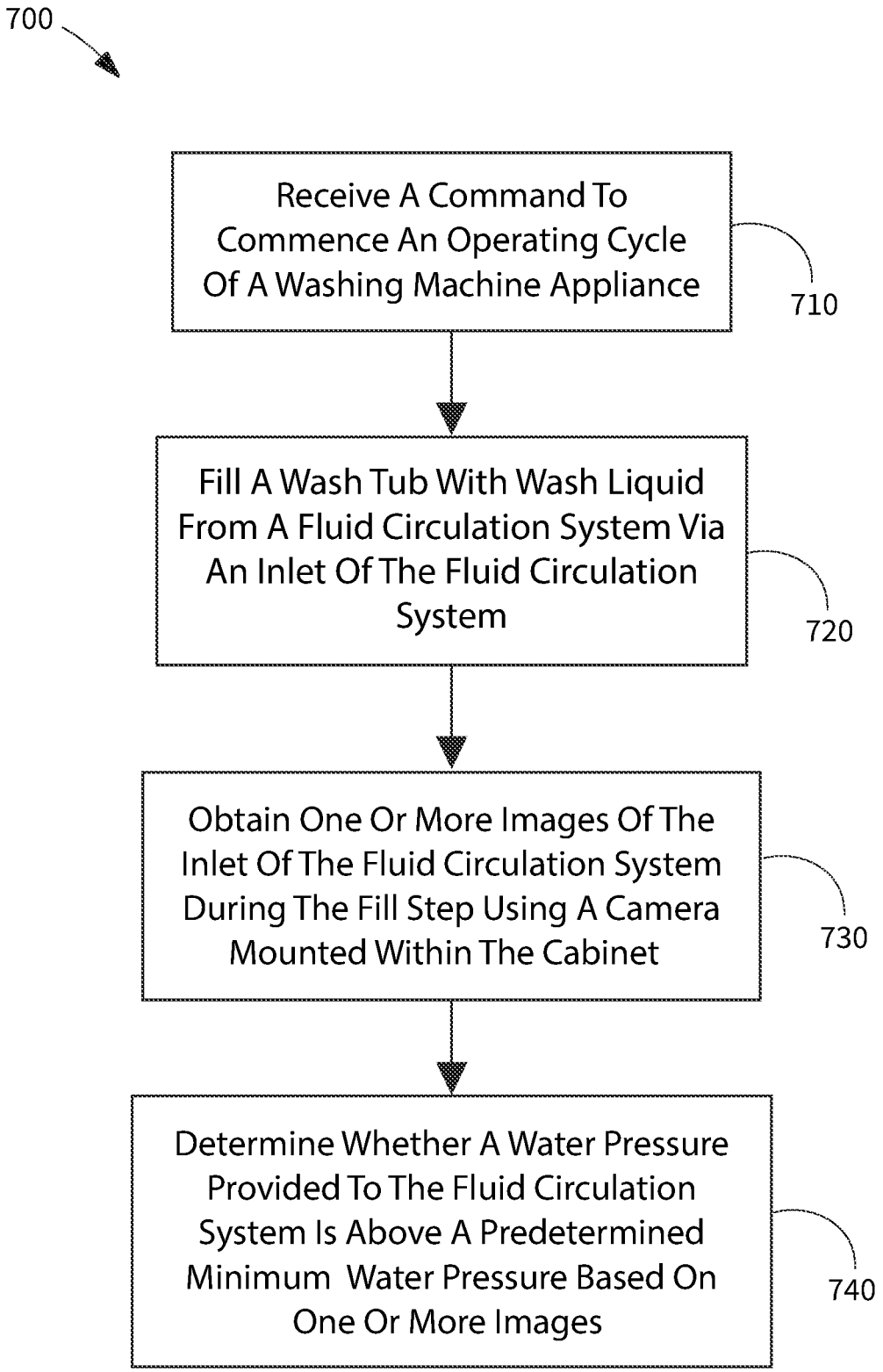
FIG. 13 illustrates a method of operating a washing machine appliance according to another exemplary embodiment of the present subject matter.

FIG. 13 illustrates an example embodiment of a method 700 of operating a washing machine appliance according to the present subject matter. Method 700 can be used to operate any suitable washing machine appliance, such as washing machine appliance 50 (FIG. 1). Method 700 may be programmed into and implemented by controller 100 (FIG. 2) of washing machine appliance 50. However, this is only by way of example, method 700 may also be used to operate various other washing machine appliances which differ from the example washing machine appliance 50.

As illustrated at step 710 in FIG. 13, in some embodiments, the exemplary method 700 may include and/or controller 100 may be configured for receiving a command to commence an operating cycle of the washing machine appliance. According to exemplary embodiments, the command to commence an operating cycle may be received from any suitable source in any suitable manner. For example, according to exemplary embodiments, the command to commence an operating cycle may be supplied by a user via input selectors 60 on control panel 58. Specifically, for example, the user may instruct washing machine appliance 50 to commence a normal wash cycle, rinse cycle, drain cycle, or any other suitable operating cycle of washing machine appliance 50. According to still other embodiments, the command to commence an operating cycle may be received from any other suitable source, such as a remote device via an external communication system, e.g., which may be or include a wireless communication module for transmitting and/or receiving wireless signals such as BLUETOOTH or WI-FI, etc., signals. It should be appreciated that the term "operating cycle" is generally intended to refer to any operating cycle or operation of washing machine appliance 50.

Method 700 may further include a step 720 of filling the wash tub, e.g., wash tub 64, including basket 70 therein, with wash liquid from a fluid circulation system configured for providing fluid to the wash tub via an inlet, e.g., inlet 72, of the fluid circulation system. The wash liquid may be, e.g., a wash volume of water or other wash liquid, or a rinse volume, etc., for example depending on the selected operating cycle at step 710. The volume of wash liquid, e.g., wash volume or rinse volume, etc., may be a predetermined amount, e.g., a volume such as in gallons, of wash liquid that is expected for the selected operating cycle, and may include a tolerance range. The volume of wash liquid actually provided during the filling step 720 may be determined, e.g., inferred or estimated, based on an on time of a fill valve, e.g., valve 74 (FIG. 2), and an assumed flow rate. Accordingly, as mentioned, when the actual flow rate is less than the assumed flow rate, such as outside of a tolerance range of the assumed flow rate, e.g., due to low water pressure, the estimated volume of water provided during the filling step 720 may be inaccurate and the actual volume of water supplied during the on time of the fill valve may be outside of (below) the tolerance range of the expected volume, e.g., wash volume or rinse volume. For example, when the water pressure provided to the fluid circulation system of the washing machine appliance is below a predetermined minimum water pressure, the flow rate from the inlet may be reduced and the actual volume of water supplied during the on time of the fill valve may be outside of (below) the tolerance range of the expected volume.

While filling the wash tub at step 720, e.g., while the fluid stream 1000 is flowing from the inlet 72, the method 700 may also include a step 730 of obtaining one or more images using a camera mounted within the cabinet. The camera may define a field of vision, and may be positioned and oriented with the inlet and/or fluid stream within the field of vision of the camera. For example, continuing the example from above, camera 200 may be used to obtain an image or a series of images within the wash chamber 73 during the filling step 720. Thus, step 730 includes obtaining one image, a series of images/frames, or a video of wash chamber 73 and the fluid stream 1000. Step 730 may further include taking a still image from the video clip or otherwise obtaining a still representation or photo from the video clip. It should be appreciated that the images obtained by camera 200 may vary in number, frequency, angle, resolution, detail, etc. In addition, according to exemplary embodiments, controller 100 may be configured for illuminating the tub using a tub light just prior to or while obtaining the image or images. In this manner, by ensuring wash chamber 73 is illuminated, camera 200 may obtain a clear image of wash chamber 73.

Further, the method may include a step 740 wherein the images obtained at step 730 are used to determine whether a water pressure provided to the washing machine appliance, e.g., to a fluid circulation system thereof, is above a predetermined minimum water pressure according to exemplary embodiments of the present subject matter.

In various embodiments, step 740 may include determining whether the water pressure provided to the fluid circulation system is above the predetermined minimum water pressure based at least in part on a geometric property of the fluid stream flowing from the inlet in the one or more images.

For example, the geometric property of the fluid stream may be or include a largest width of the fluid stream, e.g., as illustrated in FIGS. 5 and 6 and described above. In some exemplary embodiments, the geometric property of the fluid stream may be or include a distance from the inlet at which the fluid stream reaches a predetermined width, e.g., as illustrated in FIGS. 7 and 8 and described above. In additional exemplary embodiments, the geometric property of the fluid stream may be or include a first width of the fluid stream at a first predefined distance from the inlet and a second width of the fluid stream at a second predefined distance from the inlet, such as a ratio of the first width and the second width, e.g., as illustrated in FIGS. 9 and 10 and described above. In further exemplary embodiments, the geometric property of the fluid stream may be or include an area of the fluid stream and/or an area of a predetermined region of the fluid stream, e.g., as illustrated in FIGS. 11 and 12 and described above.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a washing machine appliance, the washing machine appliance comprising a cabinet, a wash tub mounted within the cabinet and configured for containing fluid during operation of the washing machine appliance, and a wash basket rotatably mounted within the wash tub, the wash basket defining a wash chamber configured for receiving laundry articles, the method comprising:

receiving a command to commence an operating cycle;

filling the wash tub with wash liquid from a fluid circulation system configured for providing fluid to the wash tub via an inlet of the fluid circulation system;

obtaining one or more images of the inlet of the fluid circulation system during the filling step using a camera mounted within the cabinet, the camera positioned and oriented with the inlet within a field of vision of the camera; and determining whether a water pressure provided to the fluid circulation system is above a predetermined minimum water pressure based on the one or more images, wherein determining whether the water pressure provided to the fluid circulation system is above the predetermined minimum water pressure based on the one or more images is based at least in part on a geometric property of a fluid stream flowing from the inlet in the one or more images, wherein the geometric property of the fluid stream is analyzed by determining one or more dimensions of the fluid stream based on a number of pixels in the one or more images along one or more lines across or through the fluid stream.

2. The method of claim 1, further comprising increasing a valve open time when the water pressure provided to the fluid circulation system is not above the predetermined minimum water pressure.

3. The method of claim 1, further comprising providing a user notification when the water pressure provided to the fluid circulation system is not above the predetermined minimum water pressure.

4. The method of claim 1, wherein the geometric property of the fluid stream comprises a largest width of the fluid stream.

5. The method of claim 1, wherein the geometric property of the fluid stream comprises a distance from the inlet at which the fluid stream reaches a predetermined width.

6. The method of claim 1, wherein the geometric property of the fluid stream comprises a first width of the fluid stream at a first distance from the inlet and a second width of the fluid stream at a second distance from the inlet.

7. The method of claim 1, wherein the geometric property of the fluid stream comprises an area of the fluid stream.

8. The method of claim 1, wherein the step of obtaining one or more images of the inlet of the fluid circulation system comprises taking multiple images of the inlet over a specified time period during the filling step, and wherein determining whether the water pressure provided to the fluid circulation system is above the predetermined minimum water pressure is based at least in part on a geometric property of a fluid stream flowing from the inlet over the specified time period.

9. A washing machine appliance, comprising:

a cabinet;

a wash tub mounted within the cabinet and configured for containing fluid during operation of the washing machine appliance;

a wash basket rotatably mounted within the wash tub, the wash basket defining a wash chamber configured for receiving laundry articles;

a fluid circulation system configured for providing fluid to the wash tub via an inlet of the fluid circulation system;

a camera mounted within the cabinet, the camera positioned and oriented with the inlet within a field of vision of the camera; and a controller, the controller configured to:

receive a command to commence an operating cycle;

fill the wash tub with wash liquid from the inlet;

obtain one or more images of the inlet during the fill step using the camera; and determine whether a water pressure provided to the fluid circulation system is above a predetermined minimum water pressure based on the one or more images, wherein determining whether the water pressure provided to the fluid circulation system is above the predetermined minimum water pressure based on the one or more images is based at least in part on a geometric property of a fluid stream flowing from the inlet in the one or more images, wherein the geometric property of the fluid stream is analyzed by determining one or more dimensions of the fluid stream based on a number of pixels in the one or more images along one or more lines across or through the fluid stream.

10. The washing machine appliance of claim 9, wherein the controller is further configured to increase a valve open time when the water pressure provided to the fluid circulation system is not above the predetermined minimum water pressure.

11. The washing machine appliance of claim 9, wherein the controller is further configured to provide a user notification when the water pressure provided to the fluid circulation system is not above the predetermined minimum water pressure.

12. The washing machine appliance of claim 9, wherein the geometric property of the fluid stream comprises a largest width of the fluid stream.

13. The washing machine appliance of claim 9, wherein the geometric property of the fluid stream comprises a distance from the inlet at which the fluid stream reaches a predetermined width.

14. The washing machine appliance of claim 9, wherein the geometric property of the fluid stream comprises a first width of the fluid stream at a first distance from the inlet and a second width of the fluid stream at a second distance from the inlet.

15. The washing machine appliance of claim 9, wherein the geometric property of the fluid stream comprises an area of the fluid stream.

16. The washing machine appliance of claim 9, wherein the step of obtaining one or more images of the inlet of the fluid circulation system comprises taking multiple images of the inlet over a specified time period during the fill step, and wherein determining whether the water pressure provided to the fluid circulation system is above the predetermined minimum water pressure is based at least in part on a geometric property of a fluid stream flowing from the inlet over the specified time period.

* * * * *